US008356387B1

(12) United States Patent
Mattix

(10) Patent No.: US 8,356,387 B1
(45) Date of Patent: Jan. 22, 2013

(54) BI-FOLD DOOR STRUCTURAL INTEGRITY CLAMPING ASSEMBLY

(76) Inventor: Timothy Jude Mattix, Cross Plains, WI (US)

( * ) Notice: Subject to any disclaimer, the term of this patent is extended or adjusted under 35 U.S.C. 154(b) by 615 days.

(21) Appl. No.: 12/246,496

(22) Filed: Oct. 6, 2008

(51) Int. Cl.
*A47H 15/00* (2006.01)

(52) U.S. Cl. ..... 16/97; 16/382; 160/118; 160/206

(58) Field of Classification Search ..... 16/229, 16/382, 386–389, 392, 97; 160/199, 206, 160/210, 213, 118; 248/220.1
See application file for complete search history.

(56) References Cited

U.S. PATENT DOCUMENTS

| | | | | |
|---|---|---|---|---|
| 2,915,118 A | | 12/1959 | Capitani | |
| 3,221,804 A | * | 12/1965 | Rudnick | 160/206 |
| 3,285,324 A | * | 11/1966 | Stein et al. | 160/206 |
| 3,554,267 A | | 1/1971 | Brinker | |
| 5,553,352 A | | 9/1996 | Bolton | |
| 6,418,590 B1 | | 7/2002 | Nipper et al. | |
| 6,463,625 B2 | * | 10/2002 | Mittag | 16/97 |
| 6,907,641 B1 | | 6/2005 | Liles | |

FOREIGN PATENT DOCUMENTS

CA 2542385 A1 * 7/2007

* cited by examiner

*Primary Examiner* — William L. Miller
(74) *Attorney, Agent, or Firm* — Loyd W. Bonneville

(57) ABSTRACT

To the top or bottom edge of a bi-fold door panel near either its pivoting or channel guided mechanisms is attached a base plate with an opening in it through which is passed into the panel either pivoting or track sliding hardware. A clamping plate is attached to the panel's face at that site to provide strong lateral support so that pin wobble is avoided. A backing plate may also be attached to the opposing side of the panel for reinforcement. It is generally necessary to drill some holes in the door to complete the arrangement. If desired, the plates may be welded to one another along an edge or otherwise manufactured as one-piece unified structure. The hardware may be sold in kits for repair or preventive maintenance. Undertaking the steps involved provides a reliable method toward that end.

12 Claims, 15 Drawing Sheets

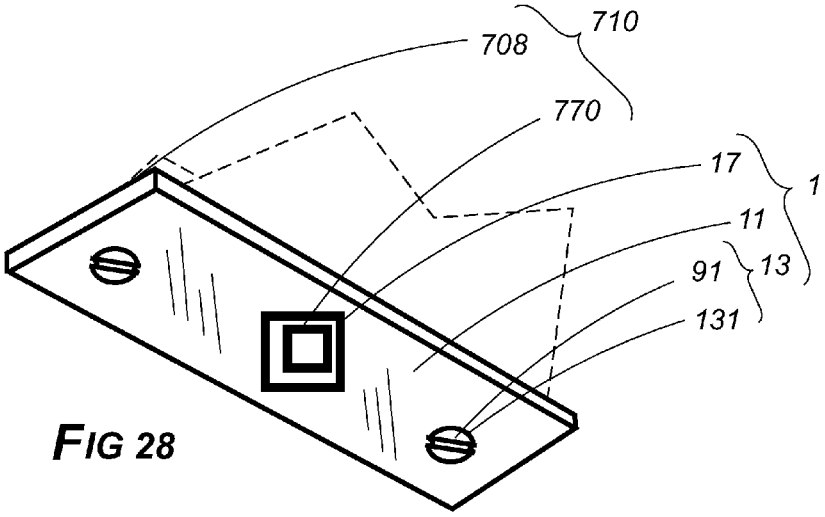
FIG 28
FIG 29
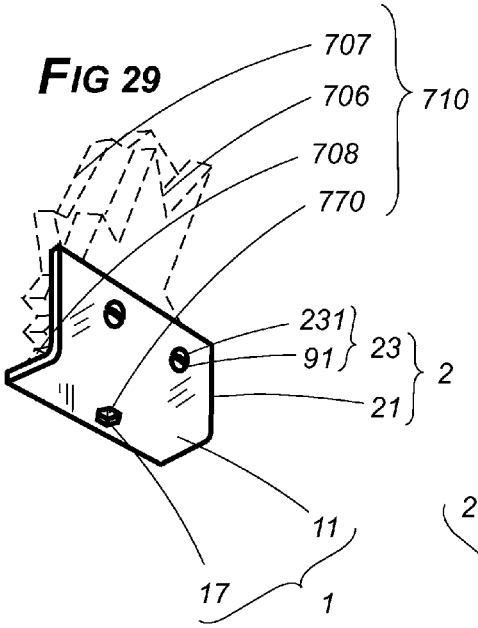
FIG 30
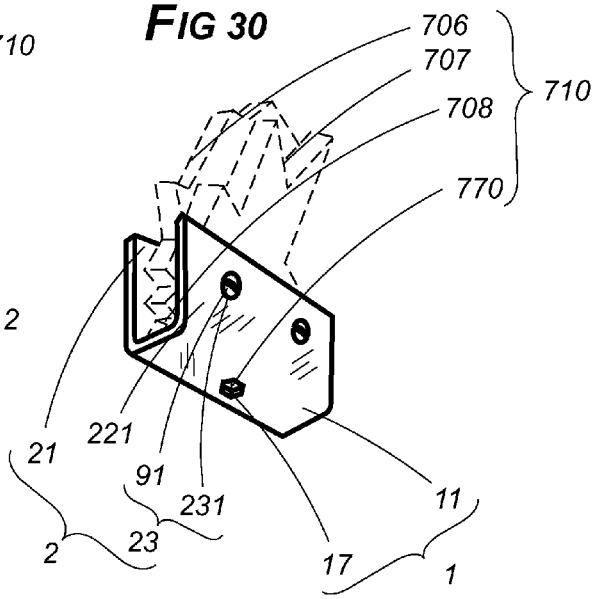

PRIOR ART
FIG 31
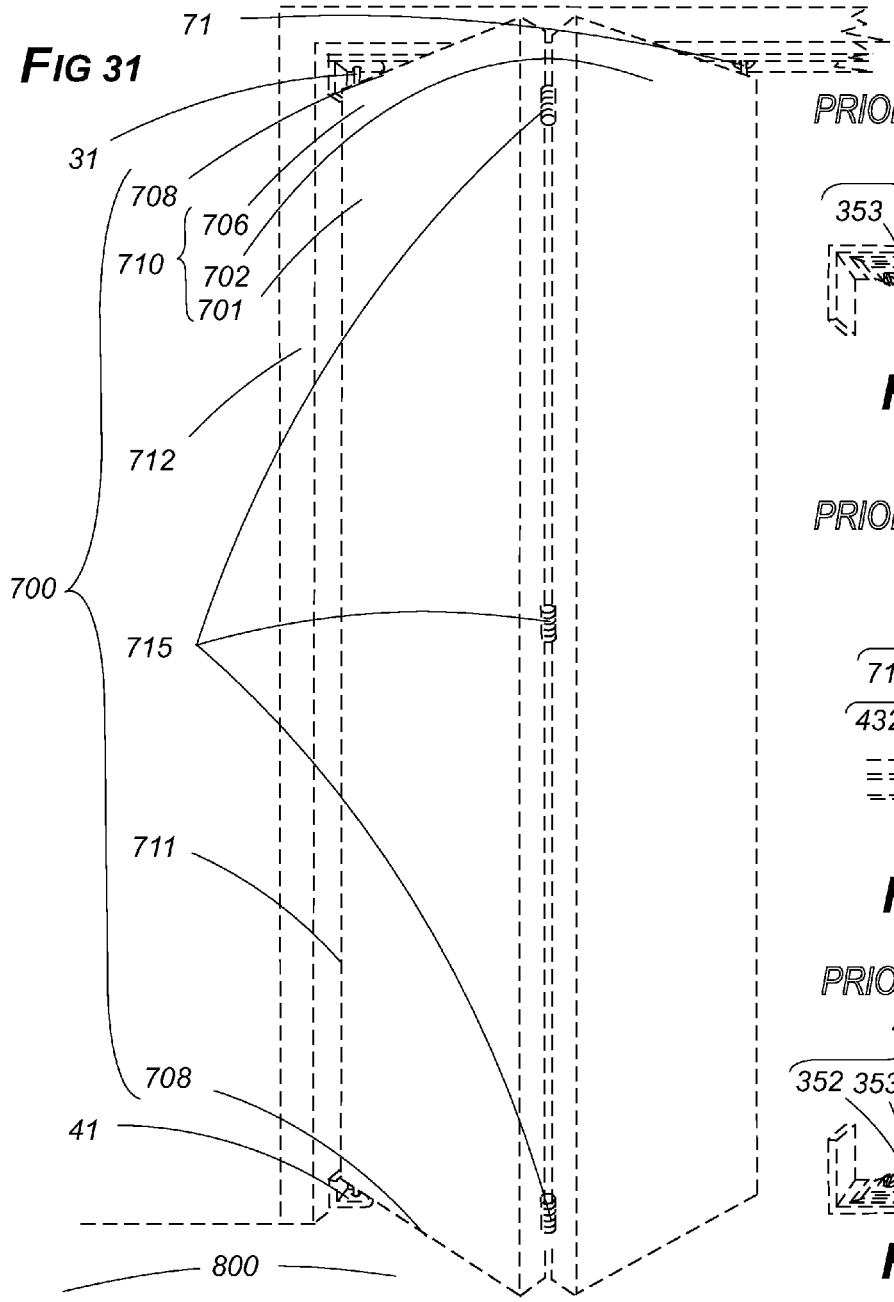
PRIOR ART
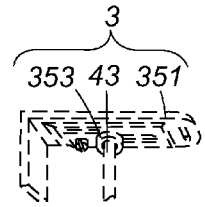
FIG 32
PRIOR ART
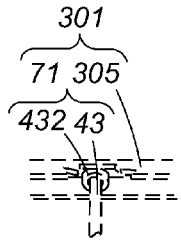
FIG 33
PRIOR ART
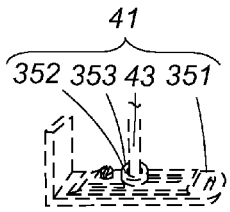
FIG 34

BI-FOLD DOOR STRUCTURAL INTEGRITY CLAMPING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

Home facilities repair

2. Description of Related Art

Occasionally a descriptive term in this application may be shortened so as to recite only a part rather than the entirety thereof as a matter of convenience or to avoid needless redundancy. In instances in which that is done, applicant intends that the same meaning be afforded each manner of expression. Thus, the term interconnecting pin jacket (42) might be used in one instance but in another, if meaning is otherwise clear from context, expression might be shortened to pin jacket (42) or merely jacket (42). Any of those forms is intended to convey the same meaning.

The term attach or fasten or any of their forms when so used means that the juncture is of a more or less permanent nature, such as might be accomplished by nails, screws, welds or adhesives. Thus it is stated herein that the base plate (11) is attached to a horizontal edge (708) of the pivot-anchored bi-fold door panel (701). Were the term used herein, a connection in which an object would be easily removed from another would be described by the word emplace. A connection in which two objects, although not attached could be separated only with considerable difficulty is referred to herein as one of rigid emplacement. The continuation of a portion of the jacket (42) through a door panel's edge (708) into the panel's retention well (770) for snug retention therein is stated herein to provide such a connection. Employment of the words connector join or any of their forms is intended to include the meaning of any of those terms in a more general way.

The word comprise may be construed in any one of three ways herein. A term used to describe a given object is said to comprise it, thereby characterizing it with what could be considered two-way equivalency in meaning for the term. Thus, it is stated that considered as one aspect, the subject matter hereof comprises a kit containing familiar objects instrumental in the repair of or provision of preventive maintenance upon a bi-fold door (700), meaning that the latter is in fact the former and the former, the latter. The term comprise may also be characterized by what might be considered one-way equivalency, as when it is stated herein that the clamping plate (21) may comprise one or more pointed screws (91) as attachment means (23), meaning that the screws (91) are themselves the attachment means (23). This use of the word has a generic sense to it. That is, a screw (91) will always be attachment means (23) but attachment means (23) may be a screw (91) in one case but something else—a nail (92), for instance—in another. However, the word comprise may also be used to describe a feature which is part of the structure or composition of a given object. Thus, the interconnecting pin (43) is said to comprise, a threaded sector (431) as a component thereof (43). The meaning in the respective cases is clear from context, however. Accordingly, modifying words to clarify which of the three uses is the intended one seem unnecessary.

Terms relating to physical orientation such as top or bottom, upper or lower, upwards or downwards, refer to the positioning of an object in the manner in which it would be typically oriented for use or viewing. It is, thus, said that the stationary spring-loaded interconnecting pin sector (703) of a panel is usually located at its top and that of the stationary retracting pin assembly, usually its bottom. Similarly, it has been the upper portion of the door-frame (712), along a horizontal channel set therein, that the bi-fold door's channel guided panel (702) has moved in the door's (700) operation; and it has also been there a receptor plate (351) has been disposed with an opposing one (351) situated upon the floor or underlying surface (800).

The term sleeved denotes a hollowed configuration wherein a first object houses a second—as exhibited by the sleeved interthreaded attachment assembly (95) of prior art. The term mated refers both to size and shape—wherein, for example, two objects may be brought together in a manner such that the outer contour of one matches the inner enwrapping surface of the other. Thus, the door panel's pin retention well (770) and the base plate's pin jacket aperture (17) are said to be mated to the jacket (42) of an interconnecting pin assembly (31, 41, 71) and that the jacket's (42) passage through and retention within the aperture (17) and pin retention well (770) are thereby accommodated.

The phrase in threaded communication with denotes the turning of the threads comprised by one object upon those of another. Thus, the manually operable retraction nut (94) comprised by the retraction pin assembly (41) in the art is described as having been disposed in threaded communication with the retraction pin's threaded sector (431) such that the pin (43) was advanced longitudinally outward from within the jacket (42) as the retraction nut (94) was rotably advanced therealong (431) and retracted within the jacket (42) upon the nut's (94) withdrawal. In the same vein, two such objects may be said to be interthreaded, such as in the case of the components of the sleeved interthreaded attachment assembly (95) preferred herein—its interthreading penetrating and tunneled members (951, 952, respectively).

The relational phrase disposed in opposition or equivalents thereof such as opposing and oppositely, indicate dual existence and locus, such as that the panel edge (708) at what is usually the door panel's (710) top is described as vertically opposing that (708) at its (710) bottom. Similarly, when bolt (93) and nut (94) dispositions are presented herein in which the nut (94) comprises clamp backing means (22) [and clamping plate attachment means (23)], its (94) orientation is said to be opposing that of the bolt (93). In door panel (710) installation, upon compression of the spring (33) of the spring-loaded pin assembly (31) at one end (708), the panel end (708) which one manipulates to clear an otherwise obstructing pin receptor plate (351) is characterized as the opposing one. And the sites at which pin anchoring receptacles (352) comprised by the pin receptor plates (351) are said to be oppositely disposed. The interconnecting pin (43) of the stationary interconnecting retraction pin assembly (41) is said to be oppositely disposed to that (43) of its companion member (43) at the panel's spring-loaded pin assembly sector (703). To provide a vise-like grip, a backing plate (221) may be attached to the panel's opposing side (707) in opposition to the clamping plate's (21) attachment. Moreover, it is in opposition that the penetrating and tunneled members (951, 952, respectively) of the sleeved interthreaded attachment assembly (95) are disposed.

Moreover, certain other words may occasionally be coined herein to simplify discussion by interchanging noun, verb or adjective or by modifying certain words. The word rotable is an example of coining use denoting the behavior of turning upon an axis rather than some sort of spinning motion which might be addressed by the more cumbersome word rotatable. It follows, then, that the frequently herein recited term rotable impeding configuration would connote a structure formed so that it cannot be so turned within an opening mated to it in cross-section. The pivot-anchored door panel's pin retention well (770) and the interconnecting pin assembly jackets (42) have both been known for some time to have comprised that property. The base plate's pin jacket aperture (17) devised herein will also be shown to have it. While polygons (61-65) inherently comprise corners which serve well in that regard, even a rounded geometric shape may be modified in cross-section with an obstructing extension at its circumference to prevent its axial turning. Even the mere addition of tiny protrusions, or studs—present on the studded polygon (66), for example—offers a slight contribution. The expression attachably is coined for convenience, in one instance at least, from the root of attach. The word tunnel is used both as a verb and noun herein, the former referring to the process of excavation required to create the object addressed by the latter—say, the tunneled member (952) of the sleeved interthreaded attachment assembly (95).

Several features of the subject matter hereof exist in pairs or comprise paired members of the assembly. Even a four paneled bi-fold door itself (700) when considered in its (700) entirety comprises this characteristic. In instances in which expression concerning such a paired feature or member is given in the singular, it should be interpreted to apply as to the paired aspect thereof.

Damage to a bi-fold door (700) includes weakening connections, cracks in its (700) composition and outright breakage. While no home or business employing such doors (700) is immune to the problem, rental units wherein residents may have less respect for property which is not their own are particularly prone to it. The unwanted effects occur following repeated opening and closing of the door (700). These operations exert forces upon the interconnection pin assemblies (31, 41, 71) which loosen the jacket (42) embedded in the door panel's pin retention well (770), ante-an effect addressed herein as pin (43) wobble. The bi-fold door (700) has been a familiar member of the interior construction of a great many homes, seemingly having made its introduction in U.S. Pat. No. 2,915,118 issued to Capitani, with modifications offered thereto in U.S. Pat. No. 4,218,057 issued to Wilson. It (700) was configured to open in folding fashion against a portion anchored to the door frame (712). Many bi-fold doors (700) comprised four panels (710)—that is, two halves in paired aspect, two panels (710) for each half on the left and two for each on the right—such that the halves would be opened outward from the center against opposing left and right pivoting vertical mounting edges (711). However, bi-fold units (700) were also known which comprised only two panels (710) folding to one side upon one another (710). Although the panels (710) are often considered herein in a generic sense, one connected to the door frame (712) comprised a pivot-anchored panel (701) and one moving along away from the door frame (712) along a pin channel (354) horizontally disposed within the frame (712), a channel guided panel (702). The two panels (701, 702) of each set were connected to one another (701, 702) by a vertically disposed panel hinge (715) which permitted them (701, 702) to fold in "V" fashion upon opening the door (700). Thus, each half of a four paneled door (700) and the entirety of a two paneled door (700) comprised one of each such panels (701, 702, respectively). The pivot-anchored panel (701) comprised the vertical mounting edge (711), supra, which, upon the door's (700) closing, seated against a vertical interior portion of the door-frame (712).

The door's (700) operable essence lay in the working system of the pivot-anchored panel (701). Proximate one of the panel's horizontal edges (708) an interconnection spring-loaded pin assembly (31) disposed at the panel's interconnecting spring-loaded sector (703), usually the top. At the vertically opposing horizontal edge (708), usually the bottom, a stationary interconnecting retraction pin assembly (41) was disposed at the panel's interconnecting retraction pin sector (704). Both of those pin assemblies (31, 41, respectively) permitted the part of the door (700) they (31, 41) were disposed upon to pivot rather than move and are, therefore, designated stationary assemblies. Different hardware permitted part of the door (700) to slide along the horizontally disposed guide channel (305), supra, and was, therefore, designated a moveable interconnecting spring-loaded channel guided pin assembly (71).

In many cases, appearing to have begun with U.S. Pat. No. 6,418,590 B1 issued to Nipper et al, the pin jacket (42) within which the pin (43) was disposed wisely comprised rotable impeding configuration to avert unwanted wear caused by the pin's (43) turning within the well (770), supra, which would have itself (770) comprised such configuration mated to that of the jacket (42). Each pin assembly (31, 41, 71) was generally attachably seated within a retention well (770) at a respective horizontal panel edge (708).

By reason of the spring-loaded feature, the pivot-anchored panel (701) was operably forced during installation against the spring's (33) compression in a manner which permitted the opposing end to clear an otherwise obstructing pin receptor plate (351) so that the pin (33) of the interconnecting retraction pin assembly (41) would be emplaced—or snap-fitted—into a pin receptacle (352) within the plate (351)—usually a socket (353)—to provide a dependable fit for the pivot-anchored door panel (701) within the door-frame (712). Thus, the door's stationary pivot-anchoring panel (701) remained anchored within the receptacles (352) at oppositely disposed pin receptor plate (351) sites—one (351) situated within the upper portion of the door-frame (712), the other (351), upon the floor or underlying surface (800).

The jacket (42), supra, of hollow elongated configuration, and an interconnecting pin (43) comprised members of each interconnecting pin assembly, whether stationary (31, 41) or moveable (71).

The stationary interconnecting spring-loaded pin assembly (31) comprised, in addition to the jacket (42) and interconnecting pin (43), a pin spring (33) disposed within the jacket (42). The interconnecting pin (43) was situated such that a portion thereof (43) was disposed also within the jacket (42) with the remaining portion extending longitudinally outward therefrom (42). The disposition of the pin (43) and spring (33) were such that during the spring's (33) expansion, a greater portion of the pin's (43) length was thrust longitudinally outward but during the spring's (33) contraction, allowed to return into the jacket (42).

The oppositely disposed stationary interconnecting retraction pin assembly (41) comprised a jacket (42) and interconnecting pin (43), the latter member (43), however, additionally having comprised a threaded sector (431). The assembly (41) further comprised a manually operable retraction nut (94) disposed externally to the jacket (42) in threaded communication with the threaded sector (431) such that the pin (43) was advanced longitudinally outward from within the jacket (42) as the retraction nut (94) was rotably advanced along the threaded sector (431) and retracted within the jacket (42) as the nut (94) was rotably withdrawn therealong (431).

The beneficial rotable impeding configuration, supra—often conferred not only upon the jacket (42) of the retraction pin assembly (41) but upon that (42) of the spring-loaded pin assemblies (31, 71) as well—manifested at prior art a hexagonal shape (62) in the jacket's (42) cross-section. Numerous other cross-sectional configurations would have been feasible without a great deal of imaginative designing, of course, including the triangle (63), square (64), pentagon (65), hexagon (62) and other conceivable polygonal shapes (61). Additionally, there might have been singly and multiply flanged models (68, 69, respectively) of any of them (61-66). To that end, the jacket (42) was also sometimes provided a studded configuration (67). Experience had demonstrated that a configuration which permitted the jacket (42) to turn or twist within the door panel's pin retention well (770)—the pin (43) wobble loosening effect—contributed to excessive wear upon the panel (710) following repeated opening and closing. Often, as a result, the panel (701) would crack and break. The retention well (770) might well also have been provided rotable impeding configuration of its own (770) in many instances, but it was observed that forcing a jacket (42) so formed (421) into even a rounded well (770) might suffice for at least temporarily acceptable impingement.

Ultimately, after one or another of the panels (710) of the doors (700) were observed to weaken and crack because of continued use thereof (700), repair solutions were devised. In U.S. Pat. No. 5,554,352 issued to Bolton, a bracket—"L" shaped in form—was attached at the corner along the panel's vertical mounting (711) and horizontal edges (711, 708, respectively) proximate the damaged part of the pivot-anchored panel (701), invariably at one of its interconnecting pin sectors (703, 704, ante). That lead was followed in Nipper et al, wherein a member of the reinforcement hardware was made to traverse the panel's entire horizontal edge (708) at the site. Although those efforts have not been in vain, what is addressed herein as pin (43) wobble was still observed to occur, attended once again by the unwanted effects. Then, in U.S. Pat. No. 6,907,641 B1 issued to Liles, a more effective piece of hardware, also "L" shaped, was devised which attached not only to an edge—a horizontal one (708)—but also to the panel's face (706).

Even where employed, however, the jacket's rotable impeding configuration, supra, was not enough to avoid the eventual problem. Stronger bracing of some sort—like that of Liles, wherein the door panel's face itself (706) was reinforced—remained to be considered. Unfortunately, for reasons apparently peculiar to the Liles assembly, including a bushing-like member disposed within the aperture of the portion thereof attached to the panel's horizontal edge (708), the rotable impeding configuration adopted in Nipper et a/was altogether absent; and as one might have expected, pin (43) wobble could not be completely eliminated. What is really required to provide suitable strength to the bi-fold door (700) and what has somehow escaped our attention is a simple, economical repair and preventive maintenance assembly which combines the rotable impeding configuration (421) of Nipper eta/with the panel face (706) bracing feature of Liles. Such an assembly might be disposed at any one of or all of the vulnerable panel sectors: the stationary interconnecting spring-loaded one (703), the stationary interconnecting pivot-anchored one (704) and the moveable interconnecting spring-loaded channel guided one (705).

Relevant to repair issues in a general sense, has been the sleeved interthreaded attachment assembly (95). In many instances, it (95) was highly preferred over other attachment means (13, 225, ante) including the pointed screw (91), the nail (92), the bolt (93) or bolt and nut combination (93, 94, respectively). The sleeved interthreaded attachment assembly (95) comprised a penetrating member (951) comprising exterior threads and a tunneled member (952)—closed at one end—comprising interior threads, each member configured to comprise a shoulder (222). The penetrating member (951) was disposed through an object to be clamped or impinged for a given reason, the tunneled member (952) disposed therethrough in opposition. Each (951, 952) comprised a shoulder (222) configured to provide a stop to prevent either's (951, 952) intrusion into the object. The members (951, 952) were, thus, disposed such that they (951, 952) interthreaded together to clamp or impinge in a vise-like manner.

While the prior art has provided a workable piece of construction in the bi-fold door (700), certain important steps may be taken to avoid or remedy damage almost certain to happen to many of them (700) during repeated use.

BRIEF SUMMARY OF THE INVENTION

In the main, the invention comprises a structural integrity clamping assembly to reinforce a bi-fold door door panel (710). In all arrangements, a base plate (11) attaches to the panel's horizontal edge (708), top or bottom—and a clamping plate (21) attaches to the face (706) of the panel (710) at an interconnecting pin sector (704). In some cases, a backing plate (221) attaches to the reverse, or opposing, side (707) of the panel (710) to provide in conjunction with the clamping plate (21) a vise-like grip upon it (710). The base plate (11) and clamping plate (21) may be formed as a singular "L"-shaped unit in what is identified herein as integral cornered support configuration. If the backing plate is similarly joined or unified, the unit becomes "U"-shaped in what is described as integral enwrapping support configuration.

Since the pivotable interconnection pin hardware (31, 41) have already been provided for us in the prior art, otherwise available retail repair kits may be embellished by adding to the package the plates (11, 21, 221) and suitable attaching means (13, 23, 225, respectively). A sleeved interthreaded attachment assembly (95) is preferred to secure the clamping plate (21) and, if present, the backing plate (221).

BRIEF DESCRIPTION OF THE SEVERAL VIEWS OF THE DRAWINGS

Solid lines in the drawings represent the invention. Dashed lines represent either non-inventive material, that not incorporated into an inventive combination hereof and which may be the subject of another invention, or that which although so incorporated, lies beyond the focus of attention. A heavily framed outline of a portion of the drawing is representative of a number of specific variations of the more generic feature it symbolically identifies. All but FIGS. 12 and 20-27 are cutaway views.

FIG. 28 comprises a generic illustration of rotable impeding configuration for both the base plate's jacket retention aperture (17) and the pivot-anchored bi-fold door panel's pin retention well (770).

FIGS. 29 and 30 depict unified plate constructions, FIG. 29 representing integral cornered support configuration, FIG. 30, integral enwrapping support configuration.

FIG. 31 represents the left half of an installed paired four-panel bi-fold door (700).

FIGS. 32-34 illustrate the seating of the interconnecting pins (43) within pin receptor receptacles (352) at interconnection pin assembly sites in FIGS. 32 and 34 and at one for a moveable assembly in FIG. 33.

DETAILED DESCRIPTION OF THE INVENTION

Figure 1:
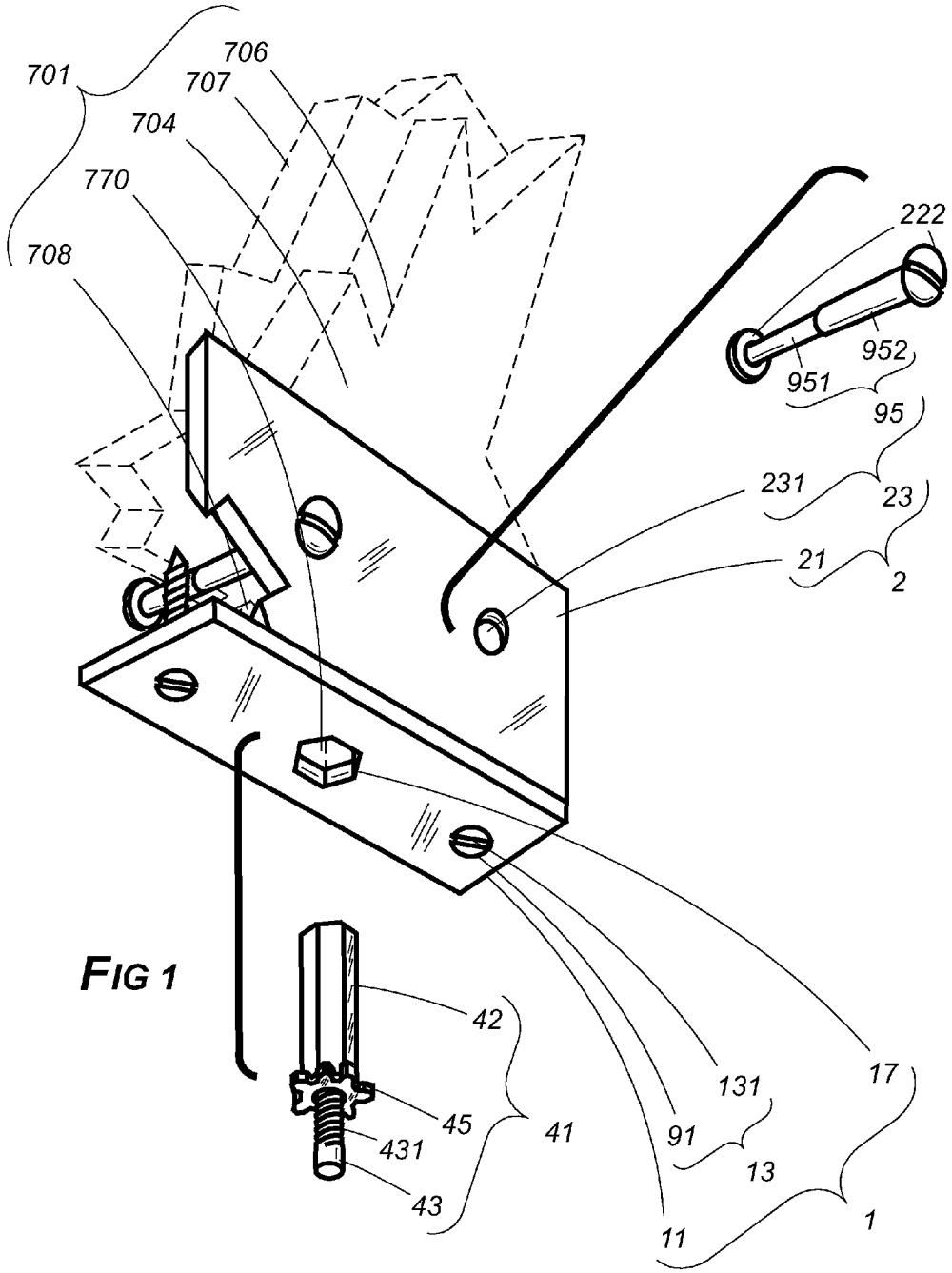
FIG. 1 is a perspective view of a preferred version of the repair assembly at the pivot-anchored door panel's interconnecting retraction pin sector (704) including a sleeved interthreaded attachment assembly (95) as a member.
Figures 2, 3:
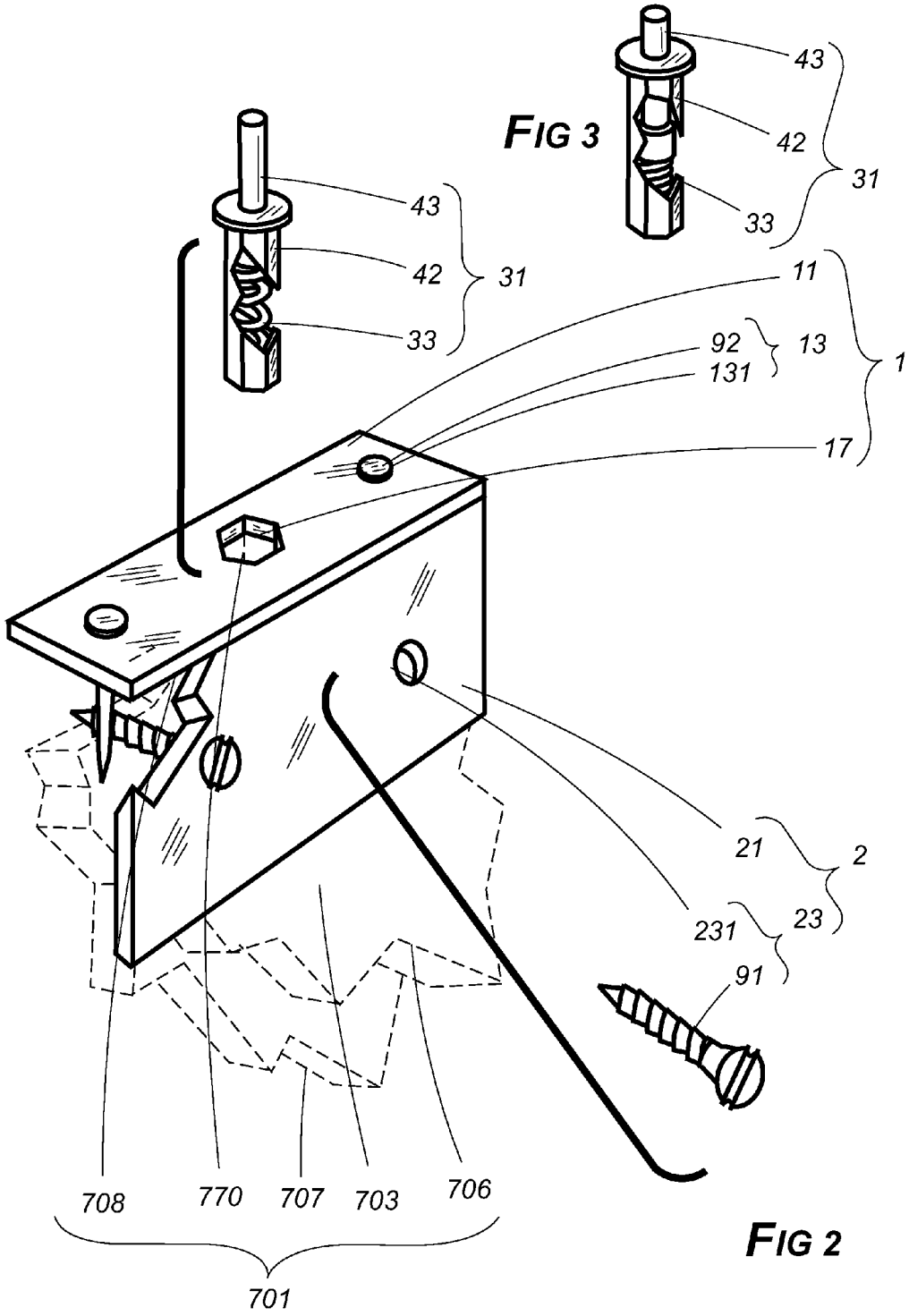
FIG. 2 depicts a portion of an assembly optionally present at the interconnecting spring-loaded pin sector (703) wherein the spring (33) of the spring-loaded pin assembly (31) is expanded.
FIG. 3 illustrates the spring (33) in compressed state.
Figure 4:
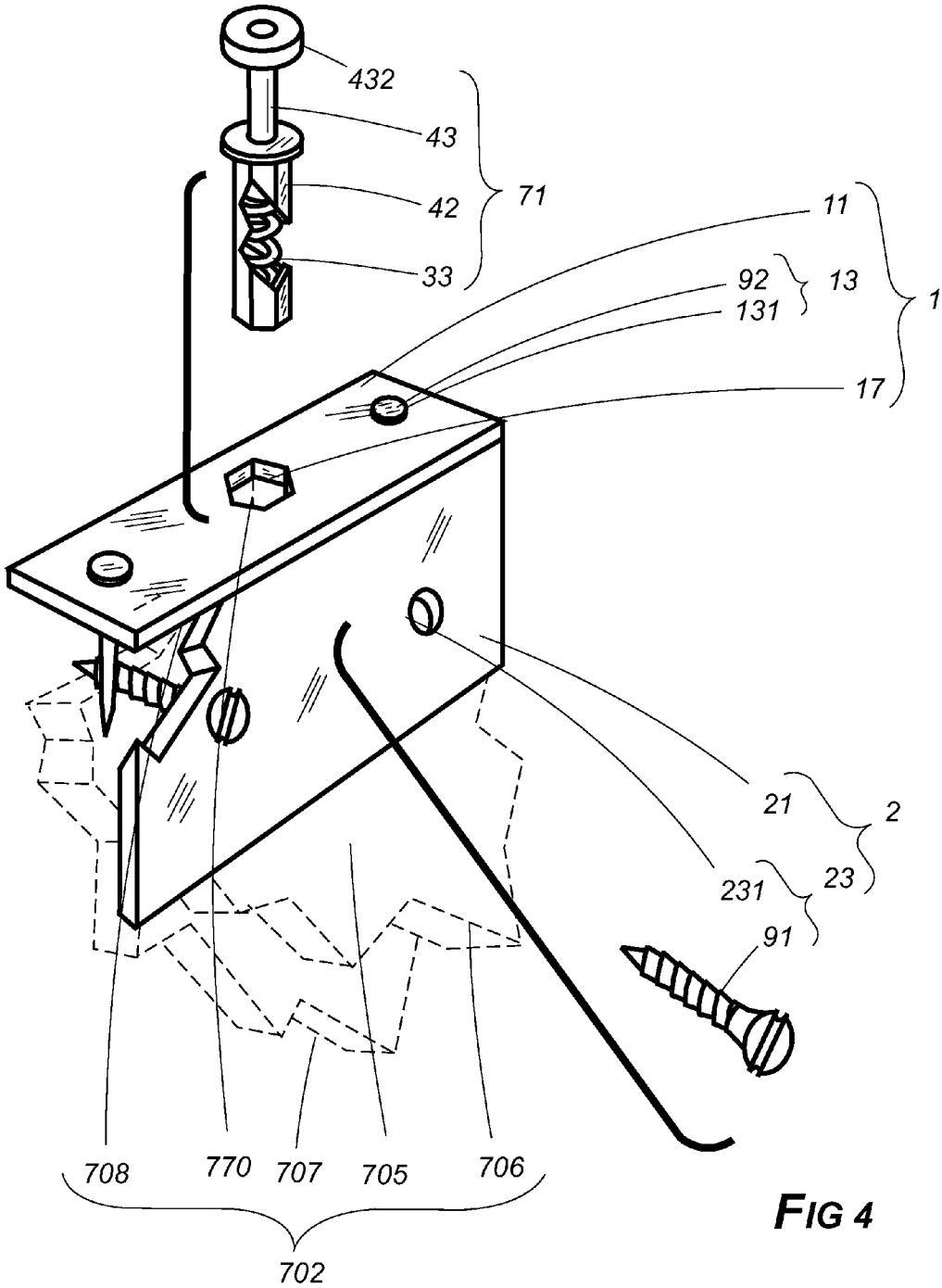
FIG. 4 comprises a portion of an assembly also optionally present at a channel guided panel's interconnecting spring-loaded pin sector (705) disclosing the interconnecting pin's seating finger (432).
Figure 5:
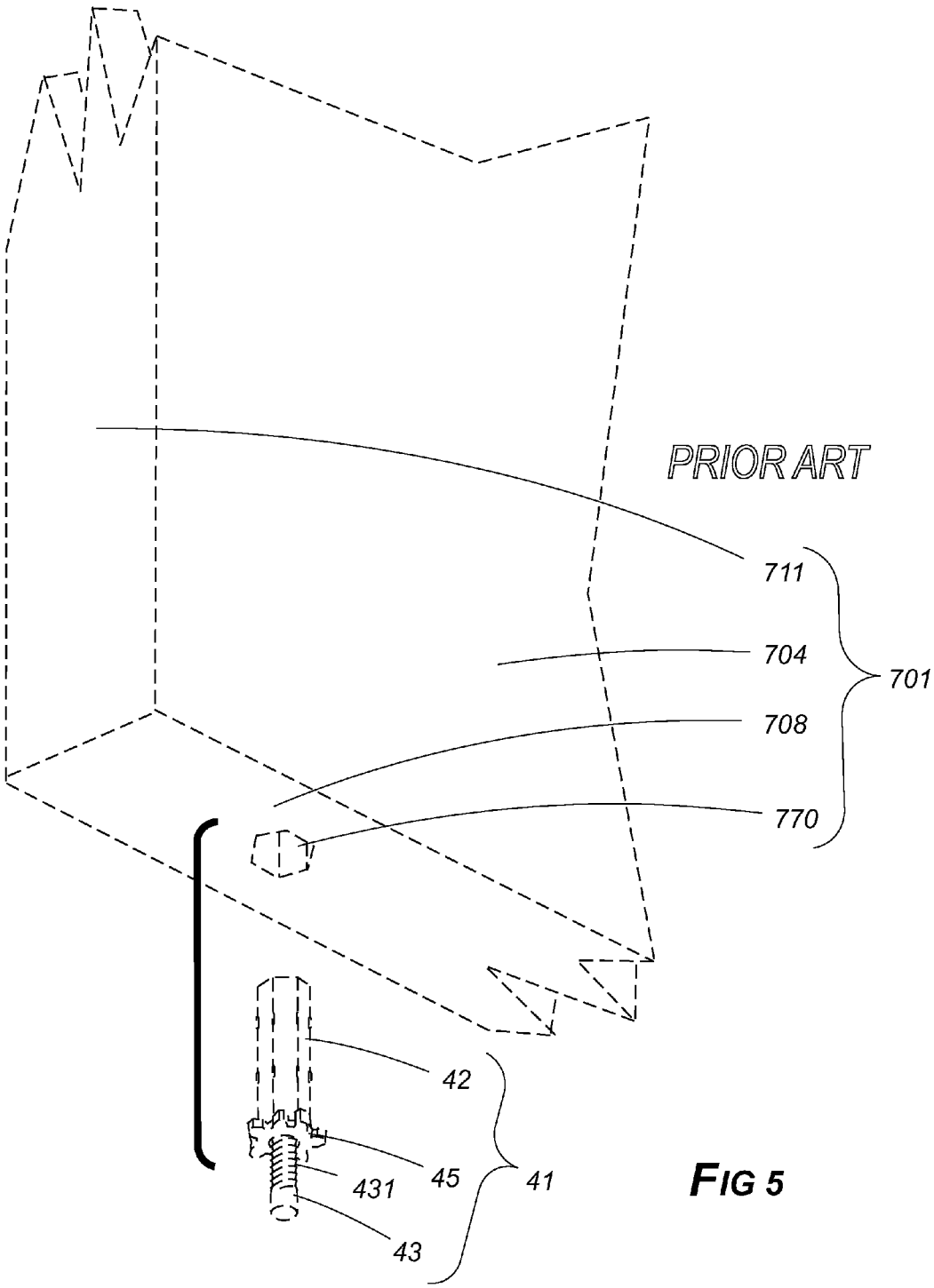
FIG. 5 represents a prior art construct wherein the interconnecting retraction pin assembly (41) includes a jacket (42) of hexagonal cross-section comprising studs.
Figure 6:
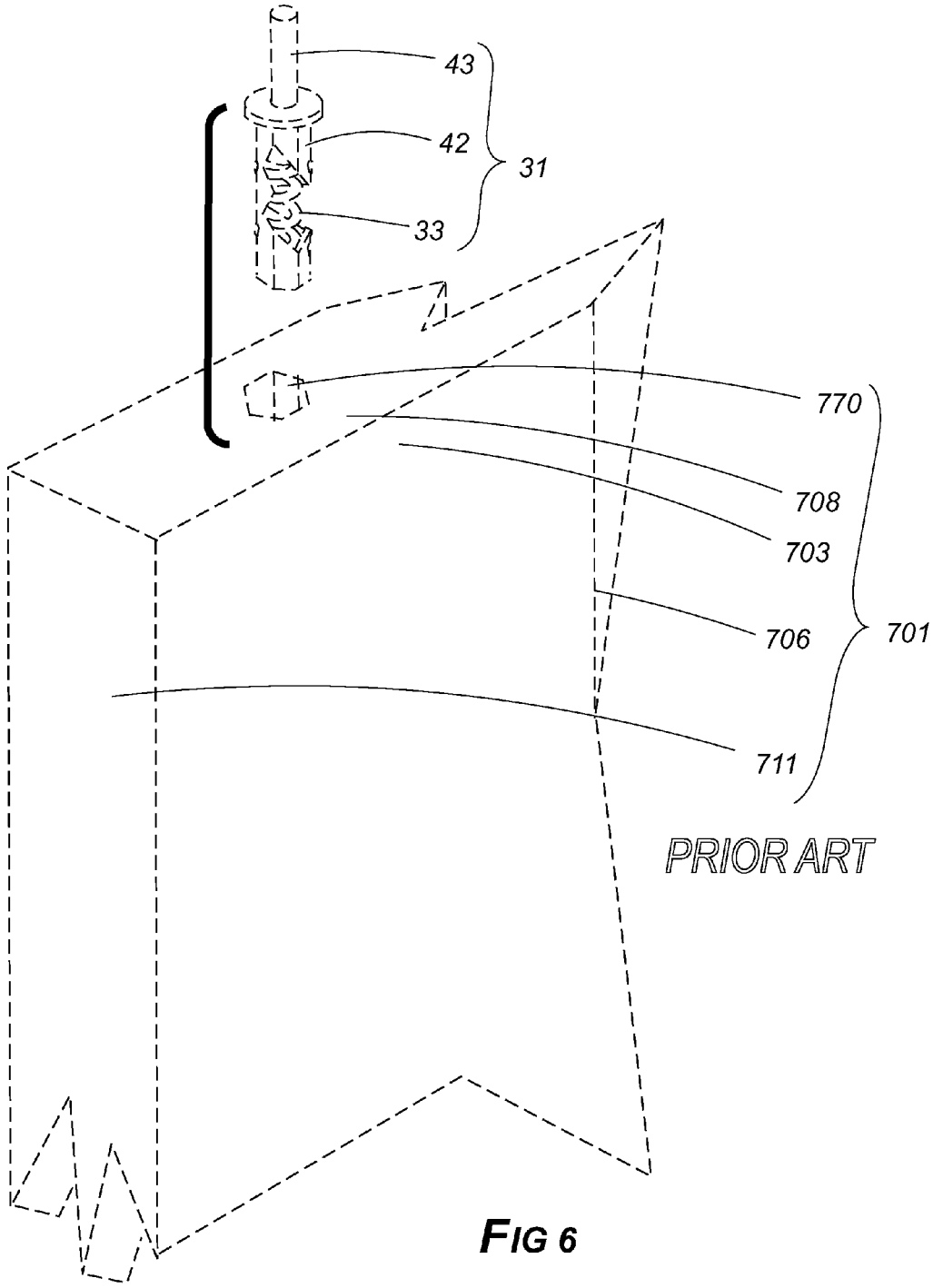
FIG. 6 illustrates also a prior art arrangement featuring a spring-loaded pin assembly (31) including a similar jacket (42).
Figure 7:
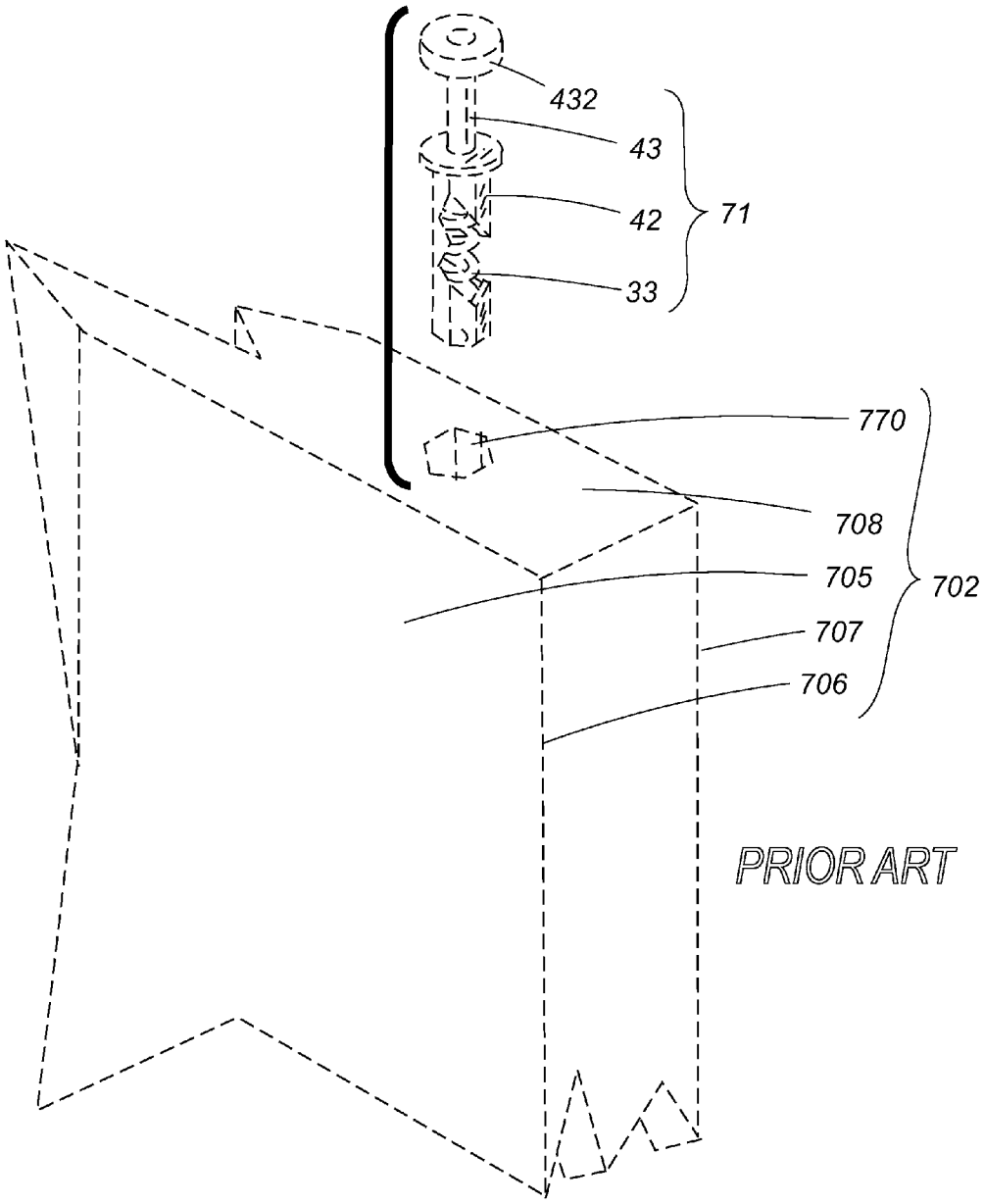
FIG. 7 illustrates an interconnecting channel guided pin assembly (71) of the prior art also including a jacket (42) of hexagonal cross-section.
Figure 8:
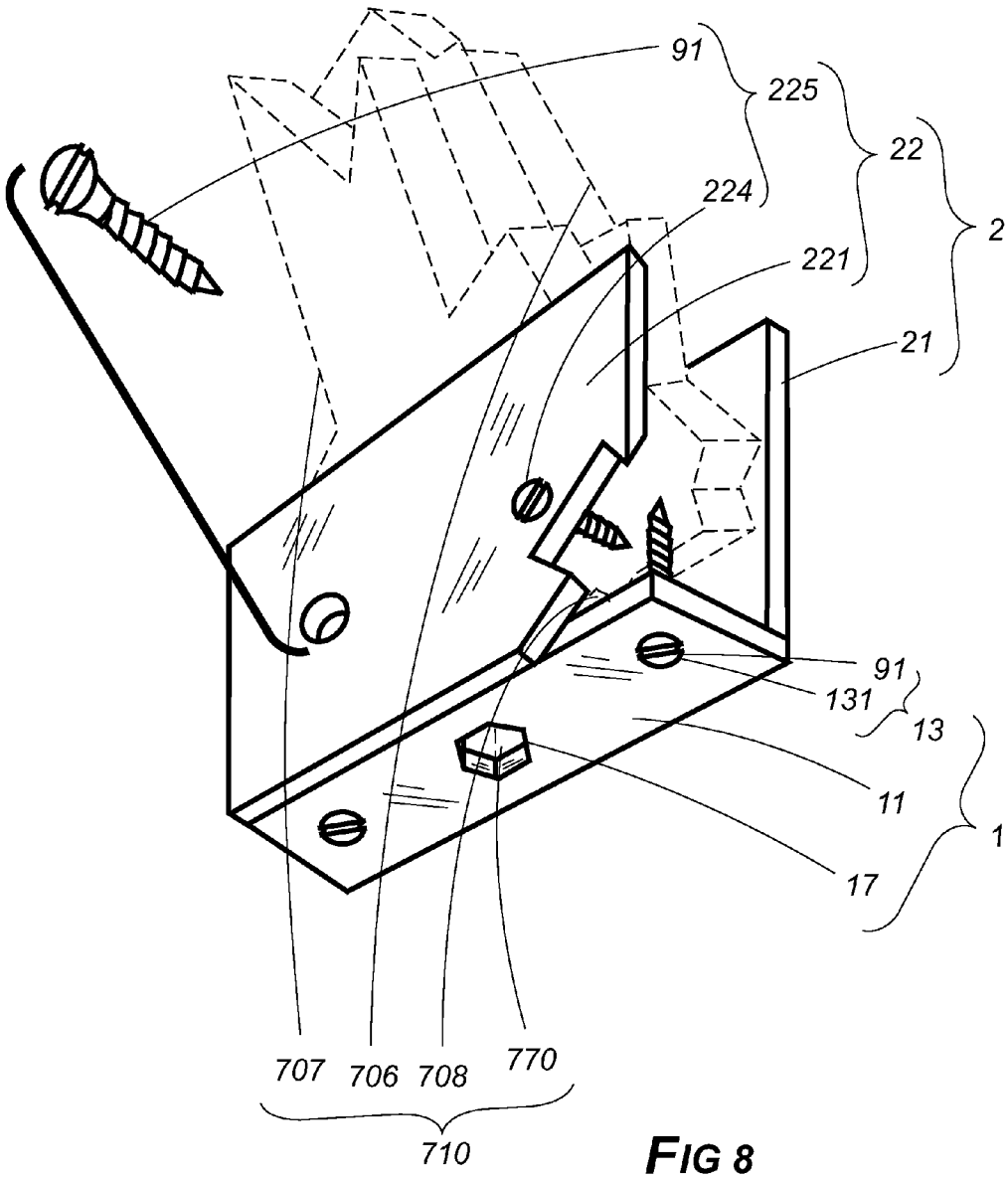
FIGS. 8-10 comprise in perspective assemblies, each additionally comprising a backing plate (221) employing, in one case or another, pointed screws (91) or nails (92) as attachment means (225) for the plate (221).
Figure 9:
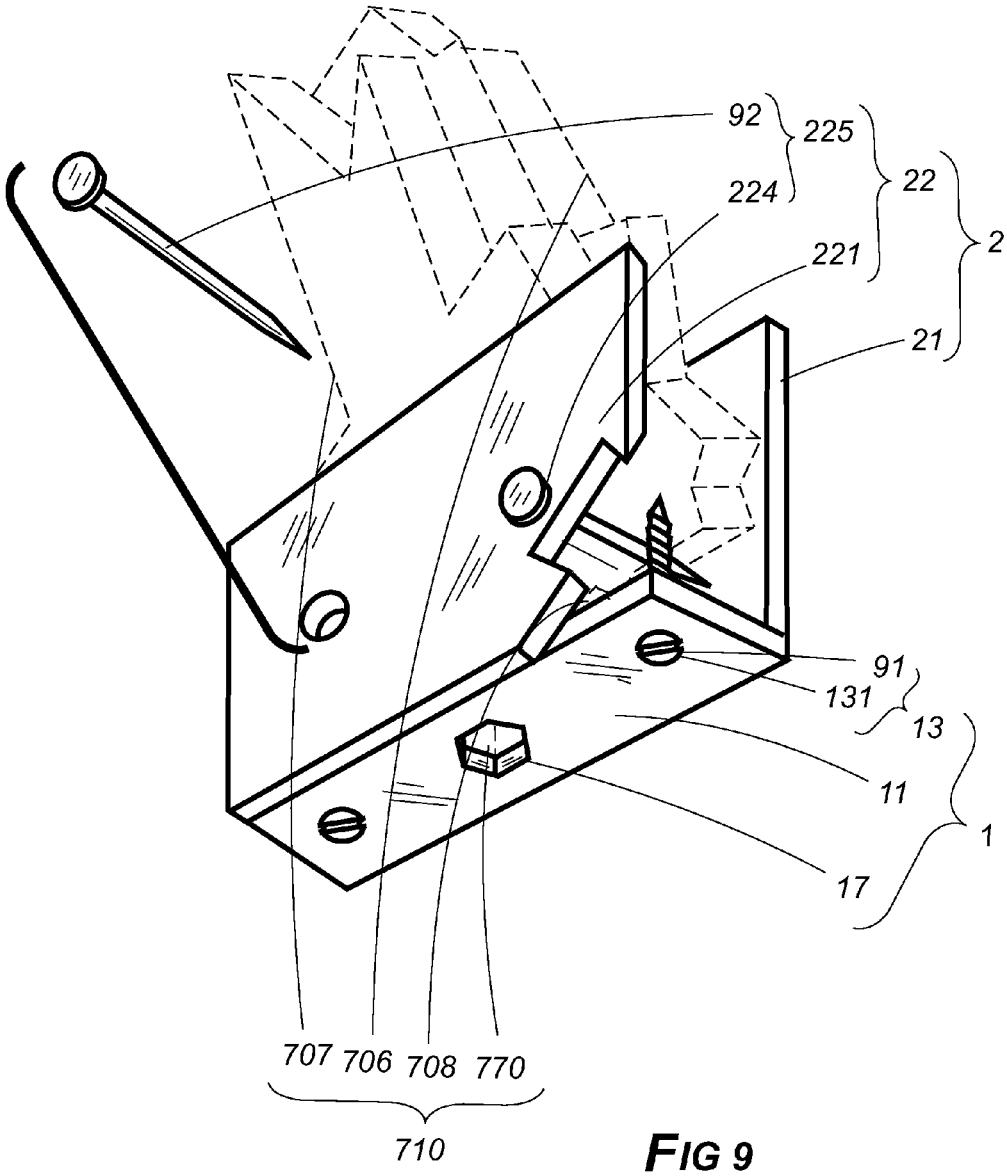
Figure 10:
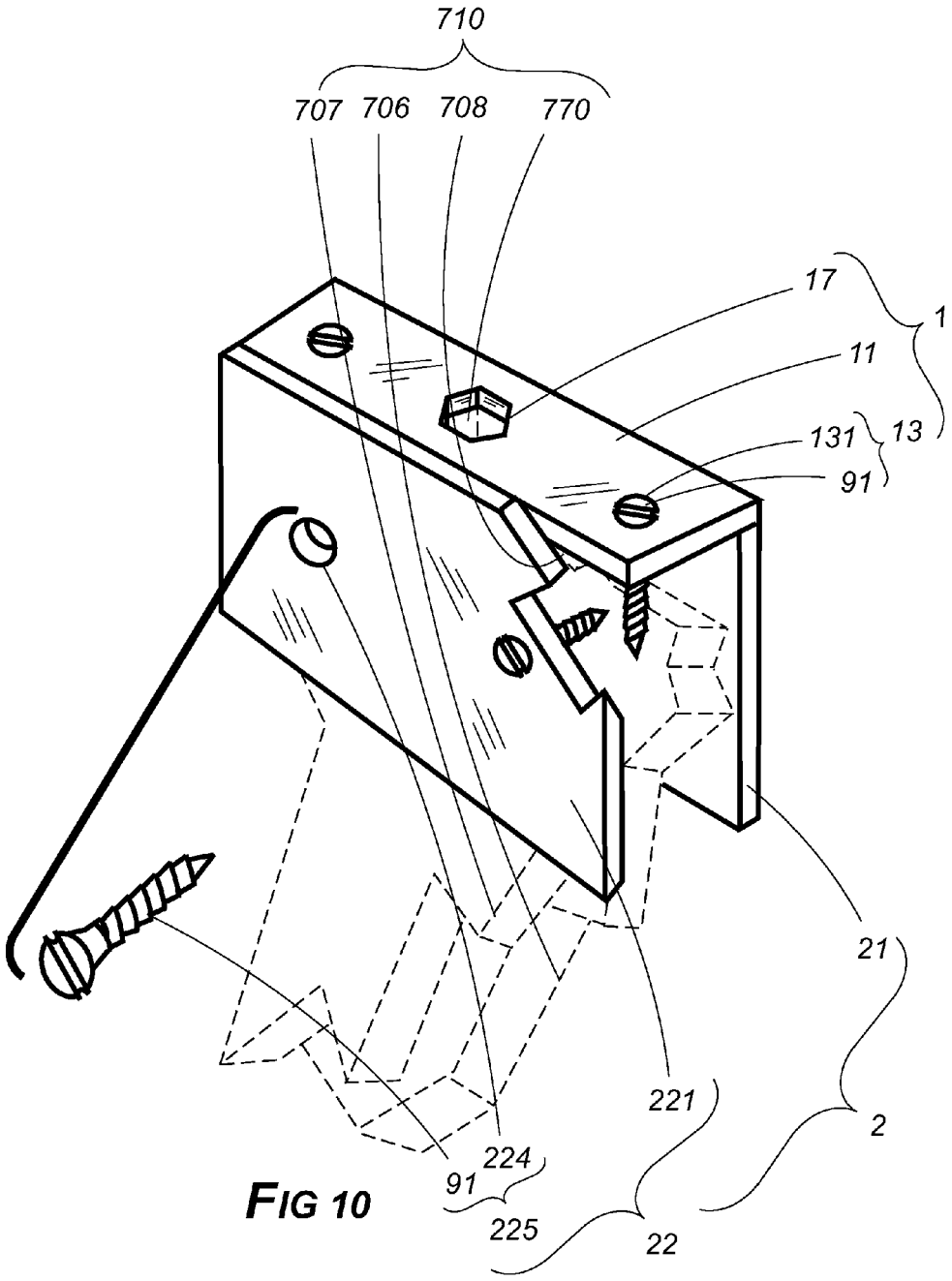
Figure 12:
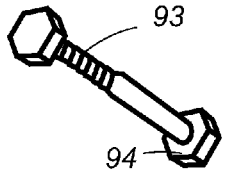
FIG. 12 illustrates a reversed disposition of the nut and bolt combination (93, 94) wherein the clamping plate assembly's clamp backing means (22) comprises the bolt (93) thereof (93, 94).
Figure 11:
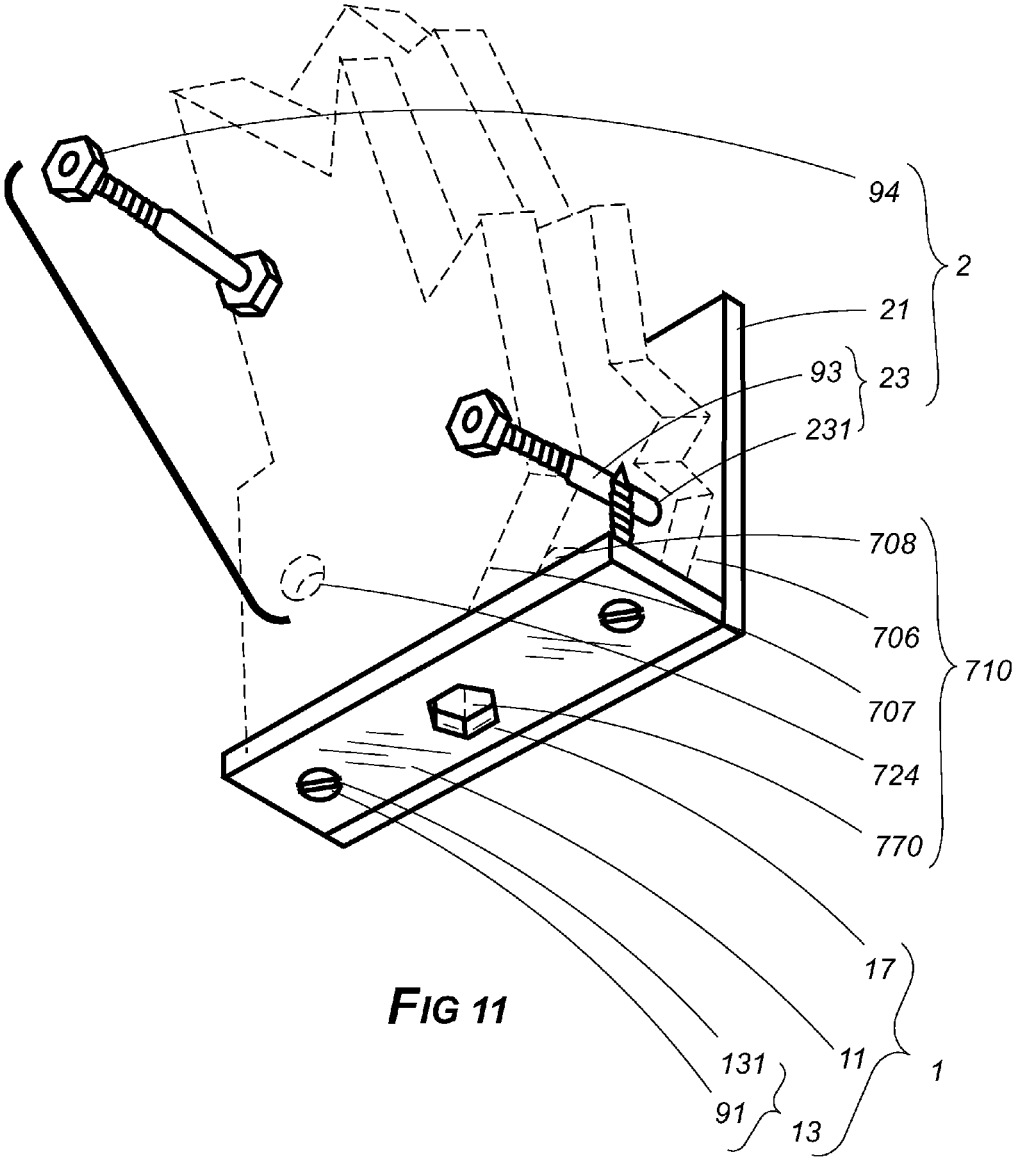
FIG. 11 depicts a simple variant of the invention wherein the nut (94) of a bolt and nut combination (93, 94) comprises the clamp backing means (22).
Figure 13:
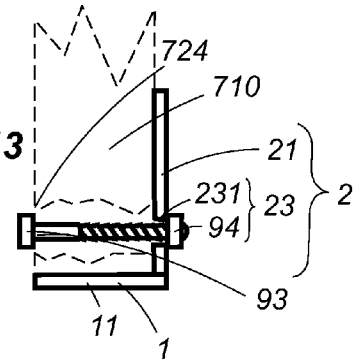
FIGS. 13-18 depict variants of clamping plate and backing plate attachment means (23, 225).
Figure 14:
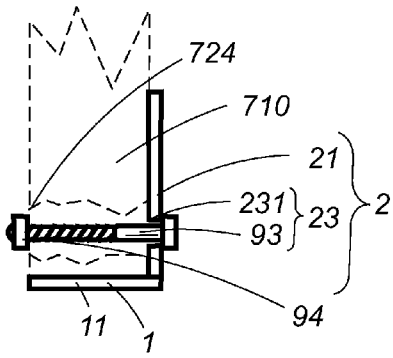
Figure 15:
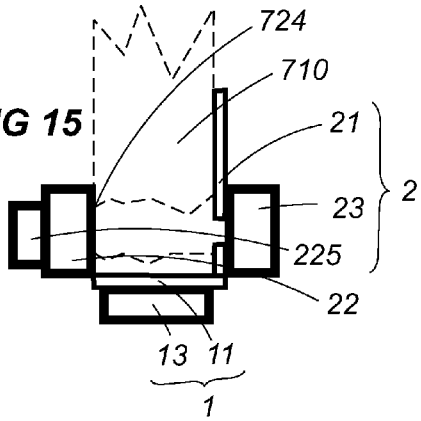
Figure 16:
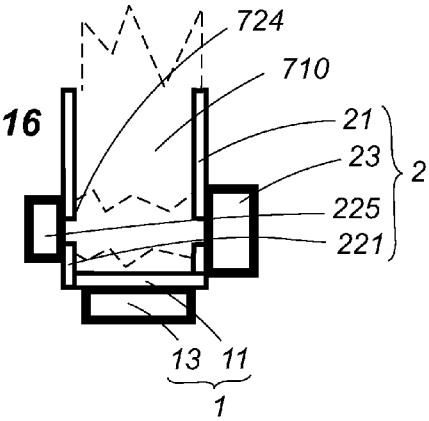
Figure 17:
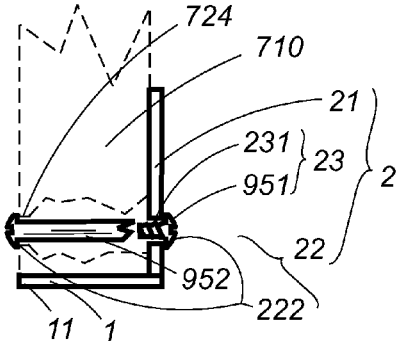
Figure 18:
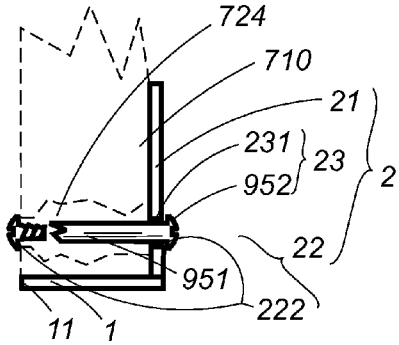
Figure 19:
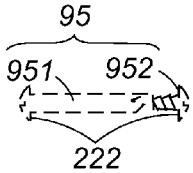
FIG 19 PRIOR ART
FIG. 19 comprises a prior art rendering of the sleeved interthreaded attachment assembly (95) preferably employed herein as a member.
Figure 20:
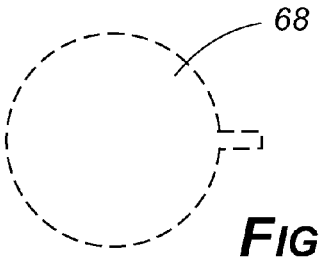
FIGS. 20-26 comprise graphic presentations of familiar geometric shapes alluded to herein, supra.
Figure 21:
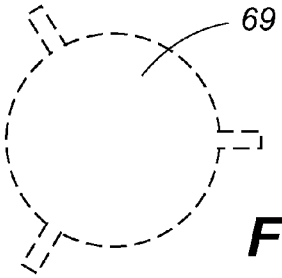
Figure 22:
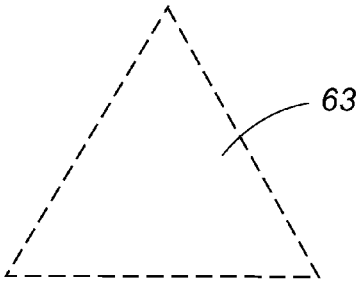
Figure 23:
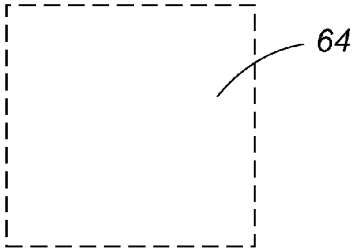
Figure 24:
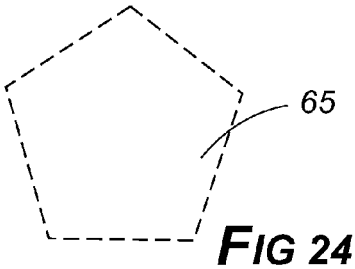
Figure 25:
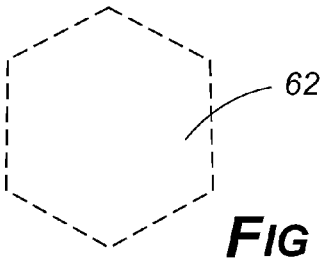
Figure 26:
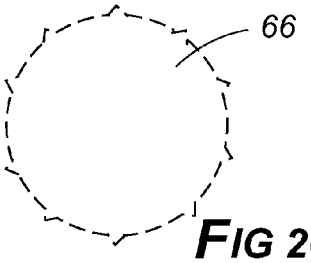
Figure 27:
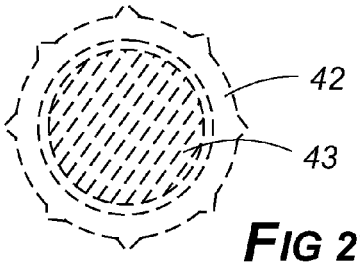
FIG 27 PRIOR ART
FIG. 27 presents a studded eight-sided jacket (42) cross-section adopted in the prior art.
Figure 35:
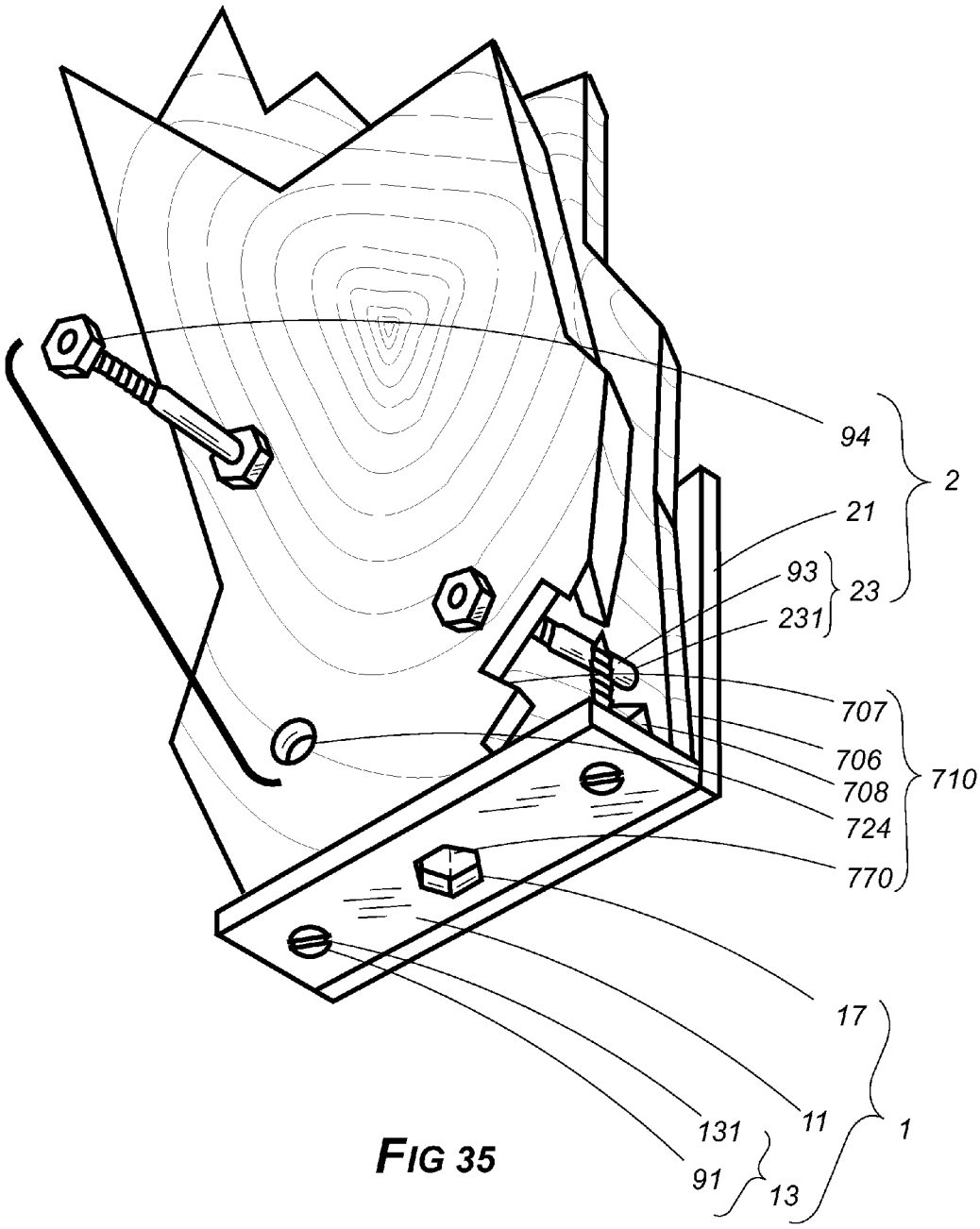
FIG. 35 comprises an inventive assembly hereof including a bi-fold door panel (710) as a member thereof.

The subject matter of this application may be considered in several aspects. First, and most obviously, it comprises an arrangement of familiar objects instrumental in the repair of or provision of preventive maintenance upon a bi-fold door (700). Second, closely related in concept, it comprises a kit containing those objects. Third, it comprises a combination including not only those objects but the bi-fold door itself (700) modified slightly to receive them. Fourth, and lastly, it comprises a method or process which one may undertake in the door's (700) repair.

For the first case, supra, the objects combined herein as a repair assembly comprise a base plate assembly (1), a clamping plate assembly (2) and an interconnection pin assembly comprising one of the three specific prior art configurations addressed supra.

The base plate assembly (1) comprises a base plate (11) and means (13) by which the plate (11) is attached to a horizontal edge (708) of a bi-fold door panel (710) requiring reinforcement.

The base plate (11) comprises rigid, durable composition and pin jacket aperture (17).

The clamping plate assembly (2) comprises a clamping plate (21) and attachment means (23) by which it (21) is affixed to the face (706) of a door panel (710).

As at prior art, supra, one of the three specific prior art configurations of an interconnection pin assembly generically comprises a stationary interconnecting spring-loaded pin assembly (31) disposed proximate the pivot-anchored panel's spring-loaded pin sector (703). Another comprises a stationary interconnecting retraction pin assembly (41) disposed proximate the pivot-anchored panel's retraction pin sector (704). As in the art, the jacket (42) of any or all members these configurations, the base plate aperture (17) and either or both of the panel's pin retention wells (770) may have conferred upon them (17, 42 and 770) rotable impeding configuration mated to one another (17, 42, 770).

The base plate (11) is disposed at any or all interconnecting pin sectors (703, 704, 705) by attachment to a horizontal edge (708) of a respective panel (710). The base plate's pin jacket aperture (17) is disposed in alignment such that the pin jacket (42) and interconnecting pin (43) outwardly directed from it (42) pass through the aperture (17) for its (42) longitudinal intrusion—consistent with the art in which no base plate (11) was present—into the respective panel's pin retention well (770) for dependent retention therein in rigid emplacement. It may, thus, be properly stated that the base plate aperture (17) is configured to accommodate the pin jacket's passage therethrough (17).

For greater reliability, the repair assembly which is the subject matter hereof preferably additionally comprises clamp backing means (22) disposed upon the opposing side (707) of the door panel (710) so as to provide in conjunction with the clamping plate (21) the desired vise-like feature addressed supra. Such means (22) may comprise a backing plate (221) in turn comprising suitable means for attachment (225) to the panel's (710) opposing side (707).

Both the clamping plate (21) and, where present, the backing plate (221) may comprise as attachment means (23, 225, respectively) one or more pointed screws (91), nails (92) or bolts (93). Both plates (21, 221, respectively), then, comprise as additionally denominated attachment means (23, 225, respectively), fastening apertures (131, 224, respectively) configured in accommodating size and disposition. In the absence of a backing plate (221), backing attachment means (225) may comprise any one the several members used for clamping plate attachment means (23). Just as in the case for attaching the clamping plate (21), one or more fastening apertures (724) must be present in the door panel (710) to accommodate that means (225).

In any event, experience demonstrates the superiority of the sleeved interthreaded attachment assembly (95), supra, over the other more common fastening devices (91-94).

For the convenience of employing nomenclature keyed to function, when adopting bolt (93) and nut (94) securing combinations, disposing the bolt (93) through the bi-fold door panel (701) from the clamping plate (21) side—that is, the panel's face (6)—characterizes it (93) herein as clamping plate attachment means (23). The opposing nut (94), thus, becomes clamp backing means (22). Disposing the bolt (93) from the panel's back or opposing side (707) characterizes it (93) as clamp backing means (22) and the nut (94) as clamping plate attachment means (23). Similarly, the shoulder (222) of the penetrating member (951) of a sleeved assembly (95) may comprise the clamping plate attachment means (23) and that (222) of the tunneled member (952), clamp backing means (22); or the opposite, if the two (951, 952) are reversed in disposition.

As with the prior art, the base plate (11) and clamping plate (21) may be attached to one another (11, 21) along an edge wherein the respective longitudinal edges of each comprise unified construction, conferring upon them (11, 21) "L"-shaped or integral cornered support configuration. The backing plate (221), where present, may be attached in similar fashion wherein the longitudinal edges of each that member (221) and the base plate (11) comprise unified construction in the same manner, providing "U"-shaped or integral enwrapping support configuration. The latter would, of course, benefit from and, perhaps, be useful primarily in instances of standardized door-panel (710) thickness, although the fit of even a slightly oversized "U"-shape might be enhanced by inserting an appropriate shim. Dimensions are also an issue in the former—that is, the "L"-shaped configuration, since it is imperative the base plate pin jacket aperture (17) be disposed in alignment with the door panel's pin retention well (770) for proper workability.

In the second case wherein the members of the subject matter hereof are considered as a kit, the base plate (11), clamping plate (21), spring-loaded and retraction pin assemblies (31, 41, 71), together with sleeved interthreaded attachment assemblies (95) for the plates (11, 21) may be packaged as a collective retail item. A backing plate (221) would preferably be included and it is feasible to employ the integral support and enwrapping configuration arrangements, if desired.

In devising repair solutions, it is often necessary to modify or alter—even if ever so slightly—the object or structure to be remedied. It is then sometimes considered more appropriate to consider not merely the members to be applied in performing the repair but the structure itself. Accordingly, in the third subject matter case hereof, the generically addressed bi-fold door panel itself (710) is included as an elemental member. As mentioned supra, the panel usually had already been modified at prior art to include the pin retention wells (770). However, openings remain to be formed in the panel (710) to affix the base plate (11), clamping plate (21) and, where present, the backing plate (221). In patenting parlance, therefore, the panel itself (710) may be—and the more fastidious might even insist must be—appropriately included as part of the inventive combination.

Finally, as a fourth inventive aspect to the subject matter hereof, there may be considered a method or process of impinging a bi-fold door panel (710) at any or all pin sectors (703-705) so as to laterally constrain movement of an interconnection pin assembly (31, 41, 71) disposed within the panel (710) in order to avoid pin (43) wobble and panel (710)-splitting damage to the door (700) during use. It is intended the method be employed upon a bi-fold door's panel (710) already having disposed within it (710), one or more pin retention wells (770), at the panels' (710) horizontal edges (708) at one or more of its spring-loaded pin sector (703), its retraction pin sector (704) and its spring-loaded channel guided sector (705). It is also intended that respective interconnecting spring-loaded and retraction pin assemblies (31, 41, 71) already be present in the panel (710), having been installed in the previously known unsupported manner. It is intended further the jacket (42) of each interconnection pin assembly (31, 41, 71) comprise rotable impeding configuration. The method comprises a succession of steps set out as hereinafter explained.

The first step is to fashion in a durable, rigid plate, herein designated a base plate (11), a pin jacket aperture (17) comprising rotable impeding configuration mated in cross-section to that (421) of the jacket (42) of an interconnection pin assembly (31, 41, 71) to be rigidly emplaced in a subsequent step within the panel's pin retention well (770). By reason of the mated configuration, the base plate aperture (17) may properly be said to accommodate the jacket (42) in passage therethrough (17) and in retention therein (17).

Next, at the interconnection pin sector (703) of the respective bi-fold door's panel (710), the base plate (11) is attached to the panel's horizontal edge (708). It is necessary to assure that base plate's pin jacket aperture (17) is directly aligned with the door panel's retention well (770).

Next, a rigid, durable plate, herein designated a clamping plate (21) is attached to the face (706) of the panel (710) at the respective interconnecting pin sector (703, 704), 705) and forming in the plate (21) fastening apertures (231) configured to accommodate in passage therethrough (231) and in retention therein (231) the radial cross-section configuration of a sleeved interthreaded attachment assembly (95).

Next, a sleeved interthreaded attachment assembly (95) is disposed to enter a respective fastening aperture (231) and to continue tunneling through the panel (710) to its opposing side (707) such that one of the assembly's shoulders (222) provides clamp backing means (22) so as to impinge in conjunction with the clamping plate (21) in a vise-like manner upon the side (707) of the panel (710) opposite that (706) of the clamping plate (21).

The inventor hereby claims:

1. A structural integrity clamping assembly to reinforce a bi-fold door, the door comprising paired opposing pivot-anchored panels, one to the left and one to the right, and paired opposing channel guided panels, one member of the pair disposed to the left, the other member thereof to the right, each pivot-anchored panel comprising an interconnecting spring-loaded pin sector disposed either at its top or its bottom and an interconnecting retraction pin sector disposed in opposition to the interconnecting spring loaded pin sector at the panel's bottom or top, respectively; each channel-guided panel comprising at its top an interconnecting retraction pin sector;

each structural integrity clamping assembly comprising a base plate assembly;

a clamping plate assembly; and an interconnection spring-loaded pin assembly configured for disposition at a pivot-anchored panel's interconnecting spring-loaded pin sector;

an interconnection retraction pin assembly configured for disposition at a pivot-anchored panel's interconnecting retraction pin sector; and configured for disposition at a channel guided panel's interconnecting retraction pin sector one of an interconnection retraction pin assembly and an interconnection spring-loaded pin assembly;

the base plate assembly comprising a base plate in turn comprising rigid, durable composition and a pin jacket aperture; and base plate attachment means;

the clamping plate assembly comprising
a clamping plate and;
clamping plate attachment means;
each interconnection pin assembly comprising
a jacket comprising hollow, elongated configuration; and
an interconnecting pin;
the jacket of each interconnection pin assembly configured for emplacement and retention within an interconnection pin retention well within the panel's interior at an interconnecting pin sector therein;
the jacket of each interconnecting spring-loaded pin assembly comprising a pin spring;
the pin spring and a portion of the length of the interconnecting pin thereof disposed within the jacket, the remaining portion thereof disposed to extend longitudinally outward therefrom; the disposition of the pin and spring being such that during the spring's expansion, a greater portion of the pin's length is thrust longitudinally outward and during the spring's contraction, is allowed to return into the jacket;
wherein, with respect to the interconnection spring-loaded pin assembly so configured for emplacement and retention within the interconnecting spring-loaded pin sector of the door's pivot-anchored panel and an interconnection retraction pin assembly so configured for emplacement and retention within the interconnecting retraction pin sector of the door's pivot anchored panel, the outwardly extending portion of the interconnecting pin is disposed to seat, respectively, into either a pin receptacle of a stationary pin receptor disposed within the door's frame or a receptacle of a stationary pin receptor disposed upon the floor;
wherein, with respect to either the interconnection retraction pin assembly or the interconnection spring-loaded pin assembly so configured for emplacement and retention within the interconnecting retraction pin sector of the door's channel guided panel, the outwardly extending portion of the interconnecting pin is disposed to move within a channel guide disposed within the door's frame;
each interconnection retraction pin assembly so configured for emplacement and retention within an interconnecting retraction pin sector of either the door's pivot-anchored panel or its channel guided panel in turn comprising
an interconnecting pin comprising a threaded sector; and
a manually operable retraction nut externally disposed with reference to the jacket upon the pin's threaded sector;
a portion of the length of the interconnecting pin of the interconnecting retraction pin assembly disposed within the jacket thereof, the remaining portion thereof disposed to extend longitudinally outward therefrom; the retraction nut disposed outside of the jacket in threaded communication with the pin's threaded sector such that the pin is advanced longitudinally outward from within the jacket as the retraction nut is rotably advanced along the threaded sector and retracted within the jacket as the nut is rotably withdrawn therealong;
the base plate disposed for attachment upon a horizontal edge of the bi-fold door's respective panel at the respective interconnecting pin sector thereof;
the jacket of each interconnection pin assembly disposed to pass longitudinally from within the pin retention well within the panel's interior through the pin jacket aperture of the base plate, such that the pin of the assembly becomes outwardly directed from the door panel's edge to continue for a pivot-anchored panel through the base plate into either a pin receptacle of a stationary pin receptor disposed within the door's frame or a receptacle of a stationary pin receptor disposed upon the floor; and to continue for a channel guided panel through the base plate into a pin receptacle of a moveable channel guided pin receptor disposed within the door's frame;
the clamping plate disposed for attachment upon the face of the bi-fold door's respective panel at the respective interconnecting pin sector thereof;
the clamping plate attachment means disposed for impingement upon the opposing side of the bi-fold door panel proximate the respective interconnection pin assembly so as to compress the plate tightly against the door and laterally constrain movement of the pin assembly within the door;
wherein, by reason of the base plate and clamping plate assemblies, the likelihood of pin wobble and door splitting damage otherwise likely to occur by reason of continued wear upon the door panel during use is diminished.

2. The bi-fold door structural integrity clamping assembly according to claim 1 wherein each pin jacket, each base plate aperture and each door panel's pin retention well all comprise rotable impeding configuration wherein the pin jacket is formed with an obstructing extension at its circumference such that the it cannot be axially turned within the base plate aperture or the pin retention well openings, the rotable impeding configuration of the jacket, base plate aperture and pin retention well thereby mated respectively to one another wherein the base plate aperture and pin retention well accommodate the pin jacket's passage therein to provide a snug fit in rigid emplacement, conferring dependent retention provided by a connection in which the pin jacket and pin retention well, although not attached can be separated only with considerable difficulty, further diminishing the likelihood of pin wobble and door splitting damage.

3. The bi-fold door structural integrity clamping assembly according to claim 1
wherein the outwardly extending portion of each channel guided interconnecting pin comprises a seating finger configured and disposed to seat in sliding fashion within a pin channel horizontally disposed within the door frame.

4. The bi-fold door structural integrity clamping assembly according to claim 1 further comprising clamp backing means disposed upon the opposing side of the pivot-anchored door panel in conjunction with the clamping plate assembly to impinge tightly upon the door;
wherein the clamping plate's attachment and retention of the interconnection pin assembly is strengthened.

5. The bi-fold door structural integrity clamping assembly according to claim 4 wherein the clamp backing means comprises a backing plate disposed by attachment to the opposing side of a respective bi-fold door panel to impinge upon the panel in conjunction with the clamping plate.

6. The bi-fold door structural integrity clamping assembly according to claim 5 wherein the base plate, clamping plate and backing plate comprise integral enwrapping support configuration wherein respective longitudinal edges of each are joined to form a singular "U" shape comprising unified construction.

7. The bi-fold door structural integrity clamping assembly according to claim 4 wherein the clamping plate's attachment means comprises one or more sleeved interthreading attachment assemblies in turn comprising interthreading parts comprising a penetrating member and a tunneled member, each comprising a respective shoulder, the shoulder of the penetrating member thereof comprising the clamping plate's attachment means and that of the tunneled member thereof comprising clamp backing means; each of the members disposed to enter opposing fastening apertures and continue through the door panel.

8. The bi-fold door structural integrity clamping assembly according to claim 1 wherein the clamping plate's attachment means comprises one or more pointed screws and fastening apertures configured in size and disposed to accommodate the passage of the screws therethrough into the door's interior;

wherein the pin jacket is reliably secured.

9. The bi-fold door structural integrity clamping assembly according to claim 1 wherein the base plate and clamping plate comprise integral cornered support configuration wherein respective longitudinal edges of each are joined to form a singular "L" shape comprising unified construction.

10. A bi-fold door structural integrity clamping kit to reinforce a bi-fold door, the door comprising paired opposing pivot-anchored panels, one to the left and one to the right, and paired opposing channel guided panels, one member of the pair disposed to the left, the other member thereof to the right, each panel comprising one or more interconnecting pin sectors;

the kit comprising one or more base plates, each comprising durable, rigid composition and a pin jacket aperture;

one or more clamping plates;

one or more sleeved interthreaded attachment assemblies; and an interconnection spring-loaded pin assembly; an interconnection retraction pin assembly and an interconnection spring-loaded channel guided pin assembly; each interconnection pin assembly comprising a jacket comprising rotable impeding configuration for disposition within a retention well formed in the door panel proximate an interconnecting pin sector, wherein the pin jacket is formed with an obstructing extension at its circumference such that it cannot be axially turned within the base plate's pin jacket aperture or the pin retention well, the rotable impeding configuration wherein the respective structures of the jacket, base plate aperture and pin retention well are mated to one another;

the base plate configured for attachment to a respective horizontal edge of the door panel;

each pin assembly configured for attachment to the door through the base plate by inserting its jacket through the aperture and disposing it snugly within a panel's retention well such that the pin of the assembly is outwardly directed from the base plate;

the clamping plate comprising durable, rigid composition for disposition by attachment means to impinge upon the face of the bi-fold door panel proximate the respective pin sector so as to laterally constrain movement of the pin assembly within the panel, thereby avoiding pin wobble and door splitting damage otherwise likely to occur by reason of continued wear upon the panel during use.

11. A structural integrity clamping assembly to reinforce a panel of a bi-fold door, each panel comprising either a stationary pivot-anchored panel or a moveable channel guided panel; the pivot anchored panel comprising an interconnecting spring-loaded pin sector disposed either at the top of the panel or the bottom of thereof, and an interconnecting retraction pin sector disposed in opposition to the interconnecting spring-loaded pin sector, at the bottom or the top of the panel, respectively, the stationary pivot-anchored panel already having formed within it at each interconnecting pin sector a retention well for an interconnection pin assembly, the moveable channel-guided panel comprising an interconnecting retraction pin sector disposed at the top of the panel, the moveable channel-guided panel already having formed within it at its interconnecting pin sector a retention well for an interconnection pin assembly;

the structural integrity clamping assembly comprising for each stationary pivot-anchored panel:

two base plate assemblies, one for disposition at the interconnecting pin sector at the top of the panel and one for disposition at the interconnecting pin sector at the bottom thereof;

two clamping plate assemblies, one for disposition at the interconnecting pin sector at the top of the panel and one for disposition at the interconnecting pin sector at the bottom thereof;

an interconnection spring-loaded pin assembly, for disposition within the retention well at the panel's interconnecting spring-loaded pin sector and an interconnection retraction pin assembly for disposition within the retention well at the panel's interconnecting retraction pin sector;

the structural integrity clamping assembly comprising for each moveable channel-guided panel:

a base plate assembly and a clamping plate assembly, for disposition at the interconnecting retraction pin sector at the top of the panel;

either, selectively, an interconnection spring-loaded pin assembly or an interconnection retraction pin assembly, for disposition within the retention well at the panel's interconnecting retraction pin sector each interconnection pin assembly whether a spring-loaded pin assembly or a retraction pin assembly comprising an interconnection pin jacket comprising hollow, elongated configuration and an interconnection pin; the jacket configured for emplacement and retention within a respective interconnection pin retention well;

each base plate assembly of the structural integrity clamping assembly comprising a rigid, durable base plate comprising a pin jacket aperture comprising cross-sectional configuration mated to that of the interconnection pin jacket wherein the base plate accommodates the jacket's passage through the aperture to provide within the door panel's pin retention well a snug fit in rigid emplacement providing dependent retention by reason of a connection in which the pin jacket and pin retention well, although not attached can be separated only with considerable difficulty; the base plate assembly further comprising means of attachment upon the respective horizontal edge of the bi-fold door's panel proximate the respective interconnecting pin sector thereof; and each clamping plate assembly of the structural integrity clamping assembly comprising a rigid, durable clamping plate and bi-fold door panel attachment means disposed to impinge upon the face of the bi-fold door panel proximate the respective interconnecting pin sector so as to compress the plate tightly against the door and laterally constrain movement of the interconnection pin assembly within the panel;

the jacket of each interconnection spring-loaded pin assembly comprising a pin spring; the pin spring and a portion of the length of the interconnection pin thereof disposed within the jacket, the remaining portion thereof disposed to extend longitudinally outward from the jacket; the disposition of the pin and spring being such that during the spring's expansion, a greater portion of the pin's length is thrust longitudinally outward and during the spring's contraction, is allowed to return into the jacket;

the interconnection pin of the jacket of each interconnection retraction pin assembly comprising a threaded sector; and a manually operable retraction nut externally disposed with reference to the jacket upon the pin's threaded sector;

a portion of the length of the interconnection pin of the interconnection retraction pin assembly disposed within the jacket thereof, the remaining portion thereof disposed to extend longitudinally outward from the jacket; the retraction nut disposed outside of the jacket in threaded communication with the pin's threaded sector such that the pin is advanced longitudinally outward from within the jacket as the retraction nut is rotably advanced along the threaded sector and retracted within the jacket as the nut is rotably withdrawn therealong;

the base plate disposed for attachment upon a horizontal edge of the bi-fold door's respective panel at the respective interconnecting pin sector thereof;

the jacket of each interconnection pin assembly disposed to pass longitudinally from within the pin retention well within the panel's interior through the pin jacket aperture of the base plate, such that the interconnection pin of the assembly becomes outwardly directed from the door panel's edge to continue for a pivot-anchored panel through the base plate into a pin receptacle of a stationary pin receptor disposed either within the door's frame or upon the floor; and to continue for a channel guided panel through the base plate into an interconnection pin receptacle of a moveable pin receptor disposed within the door's frame;

wherein, by reason of the base plate and clamping plate assemblies and the rigid emplacement of the pin jacket within the base plate's aperture and the respective panel's pin retention well, the likelihood of pin wobble and door splitting damage otherwise likely to occur by reason of continued wear upon the door panel during use is diminished.

12. A structural integrity clamping assembly comprising a bi-fold door pivot-anchored panel comprising a vertical mounting edge, an interconnecting retraction pin sector and a vertically opposed interconnecting spring-loaded sector, the two sectors disposed in proximity to the panel's mounting edge;

the panel comprising a first retention well longitudinally disposed therein proximate the interconnecting retraction pin sector;

a second retention well longitudinally disposed therein proximate the interconnecting spring-loaded pin sector;

an interconnecting retraction pin assembly disposed at the retraction pin sector;

an interconnecting spring-loaded pin assembly disposed at the spring-loaded pin sector;

a first base plate assembly comprising a rigid, durable base plate in turn comprising a pin jacket aperture and means of attachment upon the horizontal edge of the bi-fold door's pivot-anchored panel proximate the retracting pin sector thereof;

a second base plate assembly also comprising a rigid, durable base plate in turn comprising a pin jacket aperture and means of attachment upon the horizontal edge of the bi-fold door's pivot-anchored panel proximate the spring-loaded pin sector thereof;

a first clamping plate assembly comprising a rigid, durable clamping plate and bi-fold door panel attachment means disposed to impinge upon the face of the bi-fold door panel proximate the interconnecting retraction pin assembly so as to compress the plate tightly against the door and laterally constrain movement of the retraction pin assembly within the panel; and a second clamping plate assembly also comprising a rigid, durable clamping plate and bi-fold door panel attachment means disposed to impinge upon the face of the bi-fold door panel proximate the interconnecting spring-loaded pin assembly so as to compress the plate tightly against the door and laterally constrain movement of the spring-loaded pin assembly within the panel;

the structural integrity clamping assembly further comprising a bi-fold door channel guided panel comprising an interconnecting channel guided pin sector, the panel comprising a retention well longitudinally disposed therein within the interconnecting channel guided pin sector;

an interconnection channel guided pin assembly comprising an interconnecting channel guided pin disposed within a pin jacket;

the channel guided pin configured to seat in sliding fashion within a pin channel horizontally disposed within the door frame;

wherein the pin jackets of the pivot-anchored panel's interconnection retraction pin assembly, the pivot-anchored panel's interconnection spring-loaded pin assembly and the interconnection channel guided spring-loaded pin assembly;

the jacket apertures of the pivot-anchored panel's base plate disposed at the retraction pin sector thereof, the pivot-anchored panel's base plate disposed at the spring-loaded pin sector thereof and the channel guided panel's base plate disposed at the retraction pin sector thereof; together with the retention wells disposed at the pivot-anchored panel's interconnecting retraction pin sector, the pivot-anchored panel's interconnecting retraction pin sector; are all configured with rotable impeding configuration wherein the pin jackets are formed with an obstructing extension at their respective circumferences such that the jackets cannot be axially turned within the respective base plate apertures or the respective pin retention well openings, the jackets, base plate apertures and pin wells thereby comprising configuration mated respectively to one another, wherein the base plate aperture and pin retention well accommodate the pin jacket's passage therein, to provide a snug fit in rigid emplacement within a respective panel's pin retention well, conferring dependable retention provided by a connection in which the respective pin jacket, base plate aperture and pin retention well, although not attached can be separated only with considerable difficulty, wherein, by reason of the base plate and clamping plate assemblies and the rotable impeding configuration of the pin jacket, the base plate aperture and the respective panel's pin retention well, the likelihood of pin wobble and door splitting damage otherwise likely to occur by reason of continued wear upon the door panel during use is diminished.

* * * * *